US006203615B1

(12) United States Patent
Münch

(10) Patent No.: US 6,203,615 B1
(45) Date of Patent: Mar. 20, 2001

(54) DOCTORING DEVICE

(75) Inventor: Rudolf Münch, Königsbronn/Zang (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/198,788

(22) Filed: Nov. 24, 1998

(30) Foreign Application Priority Data

Dec. 12, 1997 (DE) ..... 197 55 411

(51) Int. Cl.[7] ..... B05C 11/04

(52) U.S. Cl. ..... 118/119; 118/126; 118/413; 118/419

(58) Field of Search ..... 118/126, 261, 118/413, 416, 419, 118, 119; 427/356; 162/281; 101/157, 169, 365; 15/256.5

(56) References Cited

U.S. PATENT DOCUMENTS

| | | | | |
|---|---|---|---|---|
| 3,014,454 | * | 12/1961 | Smejda | 118/126 X |
| 3,182,632 | * | 5/1965 | Vazdiki | 118/126 X |
| 3,803,665 | * | 4/1974 | Winterburn et al. | 118/126 X |
| 4,241,691 | * | 12/1980 | Hopfe et al. | 118/126 |
| 4,665,859 | | 5/1987 | Dunlap et al. | 118/126 |
| 5,433,781 | | 7/1995 | Bernert | 118/118 |
| 5,597,415 | * | 1/1997 | Graf | 118/126 X |
| 5,624,495 | | 4/1997 | Trefz et al. | 118/122 |
| 5,681,387 | * | 10/1997 | Schmidt | 118/105 |
| 5,688,326 | | 11/1997 | Kandori et al. | 118/419 |
| 6,033,477 | * | 3/2000 | Ubershar | 118/126 X |

FOREIGN PATENT DOCUMENTS

| | | | |
|---|---|---|---|
| 39 27 329 A1 | | 2/1991 | (DE) . |
| 42 07 731 A1 | | 9/1993 | (DE) . |
| 43 34 556 A1 | | 4/1995 | (DE) . |
| 196 17 485A1 | | 11/1997 | (DE) . |
| 418 476 B1 | | 6/1990 | (EP) . |
| 418476 | * | 6/1990 | (EP) . |
| 406254472 | * | 1/1994 | (JP) ..... 181/126 |

* cited by examiner

*Primary Examiner*—Laura Edwards
(74) *Attorney, Agent, or Firm*—Taylor & Aust, P.C.

(57) ABSTRACT

A device for leveling and/or metering of a layer of liquid or viscous coating medium that has been applied to a moving background includes a leveling and/or metering element, at least one power component for positioning of the leveling and/or metering element against the background, and a power transfer device through which the at least one power component acts upon the leveling and/or metering element. The at least one power component acts upon the power transfer device through at least one spring arrangement.

14 Claims, 2 Drawing Sheets

DOCTORING DEVICE

BACKGROUND OF THE INVENTION

1. Field of the Invention.

The present invention relates to a device for leveling and/or metering a layer of liquid or viscous coating medium onto a moving background. With direct application of the operating medium, the moving background is a material web, preferably a paper or cardboard web. With indirect application, it is the surface of a transfer element which transfers the liquid or viscous medium onto the material web.

2. Description of the Related Art.

When leveling and/or metering the coating medium layer on the background, precise positioning of the leveling and/or metering element against the background is of utmost importance. If the leveling and/or metering element is positioned too far from the background during operation, it will not remove the desired amount of coating medium from the background, resulting in a total coating weight that is too high. In extreme instances, the leveling and/or metering element may not even be in a position to smooth the coating medium layer to the desired extent. If, in contrast, the leveling and/or metering element is positioned too closely to the background, it will remove an excessive amount of coating medium, resulting in an overall coating weight that is too low. In extreme instances, this may even result in damage to the material web, the transfer element or the leveling and/or metering element.

Because of the aforementioned reasons, precisely adjustable power components must be utilized with conventional leveling and/or metering devices. However, such precisely adjustable power components are expensive with regard to purchase and maintenance.

Therefore, it was suggested in European patent document no. EP O 418 476 B1 to provide a lever mechanism between the power transfer device acting upon the doctor blade (=leveling and/or metering element) and the power components, which would reduce the regulating distance of the applicable power component into a correspondingly shorter regulating distance of the power transfer device. However, the suggested lever mechanisms permit only a relatively small reduction so that relatively precisely adjustable power components would still have to be used.

SUMMARY OF THE INVENTION

The invention provides a leveling and/or metering device of the generic type, which is more cost effective with regard to purchase and maintenance.

At least one power component positions a leveling and/or metering element against the background. The at least one power component acts upon the leveling and/or metering element through a power transfer device. The at least one power component acts upon the power transfer device through at least one spring arrangement.

The leveling and/or metering device according to the invention replaces the previously conventional method of regulating distance reduction by converting a power component's regulating distance into a definable adjustment force through a spring arrangement. With the spring arrangement, the leveling and/or metering element is positioned against the background through the power transfer device. This permits precise selection of the distance-power ratio even on very large regulating distances, resulting in positioning of the leveling and/or metering element against the background at the desired level of accuracy. This is because the reaction of the spring arrangement to a preselected regulating distance of the power components may be selected within wide limits as desired through an appropriate selection of the spring constants and pre-tensioning of the spring. The method in accordance with the invention, which includes at least one spring arrangement, also offers the advantage over the rigid distance-distance reduction according to European patent document no. EP O 418 476 B1 that the leveling and/or metering device may be designed"softer" in its entirety. Thus, the leveling and/or metering device may get out of the way of the momentarily thicker material layer without difficulty should the need arise, for example at the pass-through of the splice point of two material webs. This reduces the danger of damaging the leveling and/or metering element and the material web. Even if the material web winds itself around a backing roll following a web break, which would lead to a considerable enlargement of the effective diameter of this backing roll within a very short period of time, the leveling and/or metering unit according to the invention is able to withstand this diameter enlargement longer than conventional leveling and/or metering devices would be able to. This means that there is a better chance that the leveling and/or metering device would not be damaged, or not be damaged too severely during such a web break.

When it was stated earlier that the at least one power component acts "through" the at least one spring arrangement upon the power transfer device, this was meant to include design forms in which the at least one spring arrangement is located between the at least one power component and the power transfer device. It was also meant to include design forms in which the power component is mounted to the power transfer device and acts upon at least one spring arrangement which is supported on a rigid frame.

Leveling and/or metering elements may take the form of all conventional elements, such as doctor blades, metering rods, metering bars, etc., regardless of whether these elements perform a reciprocating motion transversely to the material web or whether they rotate around an axis which is arranged substantially parallel transversely to the material web.

The power transfer device is mounted on a support on which the at least one power component is also mounted. The power transfer device is flexible under the influence of the at least one power component and the at least one spring arrangement. In this instance, the power transfer device does not have to be moved relative to the support in order to be able to influence the leveling and/or metering element in various positions. This also eliminates the need of having to overcome the friction that is always associated with such a relative movement, especially static friction at the beginning of a motion. Therefore, lower efficiency and consequently cheaper power components may be utilized.

When the power transfer device is manufactured at least partially of synthetic material, manufacturing costs, as well as the forces that are necessary to achieve a pre-established distortion of the power transfer device, are reduced as compared to power transfer devices manufactured from rigid materials, such as metal. This also allows the use of lower efficiency power components.

In order to be able to remove the leveling and/or metering element from the moving background, at least one spring arrangement includes a tension spring, a compression spring and/or a tension/compression spring.

In a cost-effective design variation, at least one spring arrangement includes a coil spring. In addition, this design variation distinguishes itself in low susceptibility to dirt accumulation. Other forms of additional or alternative spring arrangements may also be used. Some examples are gas springs, resilient rubber elements and leaf springs.

In a further embodiment of the invention, at least one damper arrangement can be provided between the at least one power component and the power transfer device. This damper arrangement counteracts development of vibrations in the leveling and/or metering device, which would manifest themselves in cross streaks or so-called "barring" in the coating layer. When laying out the damping characteristics for the damping unit, it should be ensured that the ability of the leveling and/or metering unit to get out of the way of the passing splicing area is not significantly impaired. The leveling and/or metering device can accommodate the enlargement of the backing roll diameter that may result from a web break, even when utilizing the damper arrangement, due to the relatively high time constant associated with this diameter enlargement.

The damper arrangement and the spring arrangement may, for example, be laid out integrally. The fluid pass-through openings of a gas spring may, for example, be sized so that the desired damping effect is achieved. When a rubber or rubber-type spring element is used, then the material characteristics can provide the desired damping effect.

In order to enable profiling of the applied liquid or viscous mediums on the background transversely to the material web, a multitude of power components are distributed across the material web. In a first design alternative, the power transfer device may include a multitude of power transfer elements, which is especially advantageous when utilizing metering rods as the leveling and/or metering element. In this first design alternative, a continuous element, positioned transversely to the material web between the multitude of power transfer elements and the leveling and/or metering element, can be provided. This has the advantage that a different adjustment of power component and spring arrangement can be compensated for in the power transfer device in the transition area between two neighboring sections in cross direction to the material web, and not only just in the leveling and/or metering element. The adjustment difference between the two neighboring sections is therefore, being "damped" effectively and does not negatively influence the coating profile. The continuous element that is positioned transversely to the material web may be a separate element. It is, however, also possible that this function is taken over by the metering rod bed of the metering rod.

In a second design, the power transfer device may also be constructed as a single component. In order to alleviate deformation that varies in transversely positioned neighboring sections, the power transfer device may include a number of slots and/or areas of lesser wall thickness which are positioned at a certain predetermined minimum distance from the leveling and/or metering element. This predetermined minimum distance ensures that a varying deformation is averaged out in the power transfer device, rather than the leveling and/or metering element.

The slots and/or areas of thinner wall thickness may also be offset by half a separation. It is also possible to provide additional slots and/or areas of lesser wall thickness in order to achieve even better influence over the leveling and/or metering element.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
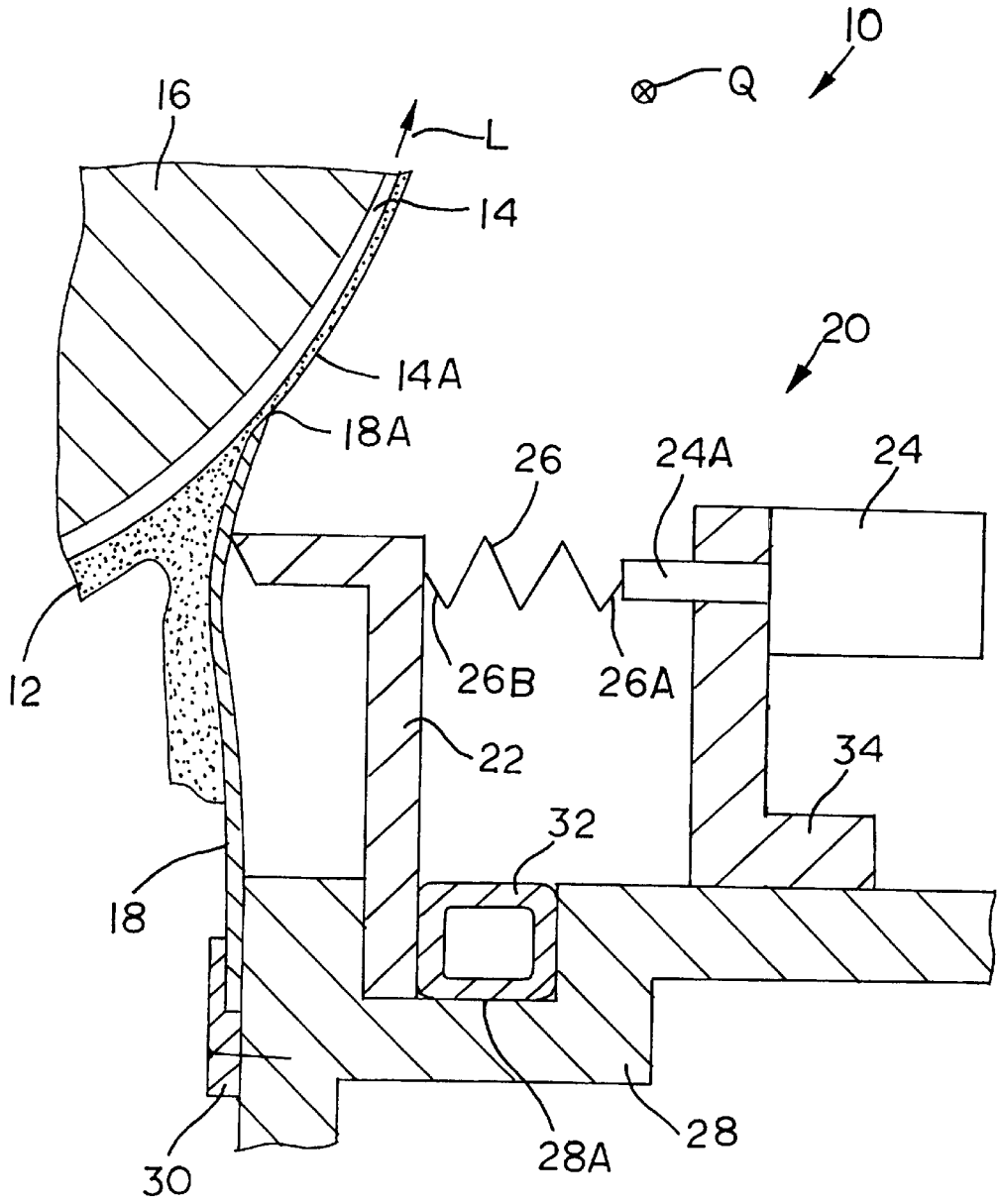
FIG. 1 is a side view of one embodiment of a leveling and/or metering device in accordance with the invention.

Referring now to the drawings and particularly to FIG. 1, there is shown a leveling and/or metering device 10 (referred to as "doctor device" in the following) of a device for applying a liquid or viscous medium 12 onto a material web 14. The material web 14 is guided around a back-up roller 16 in the area of the entire applicator unit, specifically in the area of the doctoring device 10. The back-up roller 16 in FIG. 1 rotates counter-clockwise, thereby carrying the material web 14 in the direction of the arrow L.

The coating medium 12 is applied, preferably excessively, onto the material web 14 by use of an applicator unit which is not illustrated in FIG. 1 and which, in accordance with the illustration in FIG. 1, is positioned left of the doctoring unit 10. The coating medium 12 is then transported by the movement of the back-up roller 16 to the doctoring device 10. The doctor device 10, in the embodiment of FIG. 1, includes a doctor blade 18, whose leveling or metering edge 18*a* is positioned against the surface 14*a* of the material web 14 by use of a control device 20. For this purpose, the control device 20 includes a contact bar 22 (power transfer device) which acts upon the doctor blade 18. A multitude of power components 24 are arranged side by side in cross direction Q. An appropriate number of coil springs 26 are mounted on one end 26*a* to an actuator 24*a* of power component 24, and on the other end 26*b* to the contact bar 22.

The doctor blade 18, the contact bar 22 and the power components 24 are mounted to the support beam 28. More specifically, the doctor blade 18 is held to the support beam 28 by use of a clamping device 30 which is illustrated only in rough outlines. For example, the clamping device known from EP 0 807 711 A1 may also be utilized. The contact bar 22 which, for example, may be manufactured from synthetic material and which is substantially L-shaped, is held in a recess 28*a* in the support beam 28 by use of a pressure tube 32. An L-shaped support element 34, which supports the power components 24, is also mounted on the support beam 28.

Figure 2:
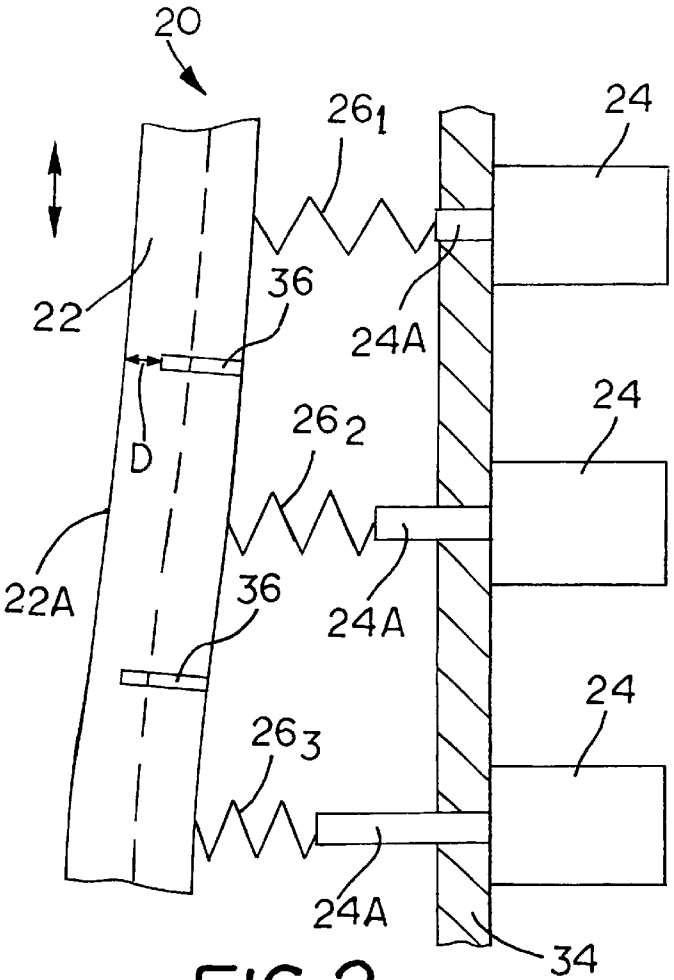
FIG. 2 is a top view of the leveling and/or metering device, in accordance with FIG. 1.

The coil springs 26 can only be used as pressure springs. However, it is possible to use them as tension springs or as compression springs. Spring $\mathbf{26}_2$ in FIG. 2 is shown in its relaxed position, consistent with the center position of the actuator 24*a* of the corresponding power component 24. In this center position, the actuator 24*a* is neither extended completely from the power component 24, nor retracted completely into the power device 24. From this center position, the spring 26 can be put under tension by pulling back the actuator 24*a* of the power component 24 in the direction of pull, as illustrated in FIG. 1 for spring $\mathbf{26}_1$. Spring 26, then exerts a force upon the contact bar 22, away from the material web 14. However, by extending the actuator 24*a* of the power component, it is also possible to load the spring 26 in compression direction, as is illustrated in FIG. 2 for spring $\mathbf{26}_3$. In this instance, the spring $\mathbf{26}_3$ exerts force upon the contact bar 22, toward the material web 14.

In the example in FIGS. 1 and 2, the contact bar 22 is constructed as a one-piece component. It is, however, equipped with slots 36 between the linkage points 26*b* of the springs 26. Slots 36 alleviate a segmented deformation in cross direction Q of the contact bar 22. The slots 36 do not extend to the contact edge 22*a* of the contact bar 22, but end at a predetermined distance d from it. Consequently, deformations of varying magnitude in neighboring sections of the contact bar 22 are compensated in the contact bar 22, rather than in the doctor blade 18, which affects the coating quality positively.

A segmented deformation of the contact bar 22 may also be alleviated by an appropriate weakening of the wall thickness of the contact bar 22, instead of providing slots 36 that fully penetrate the contact bar 22. As shown in the example in FIG. 3 it is also possible to provide separate contact elements 122 which are connected with each other through a bar 123 at the end facing the doctor blade 18.

Figure 3:
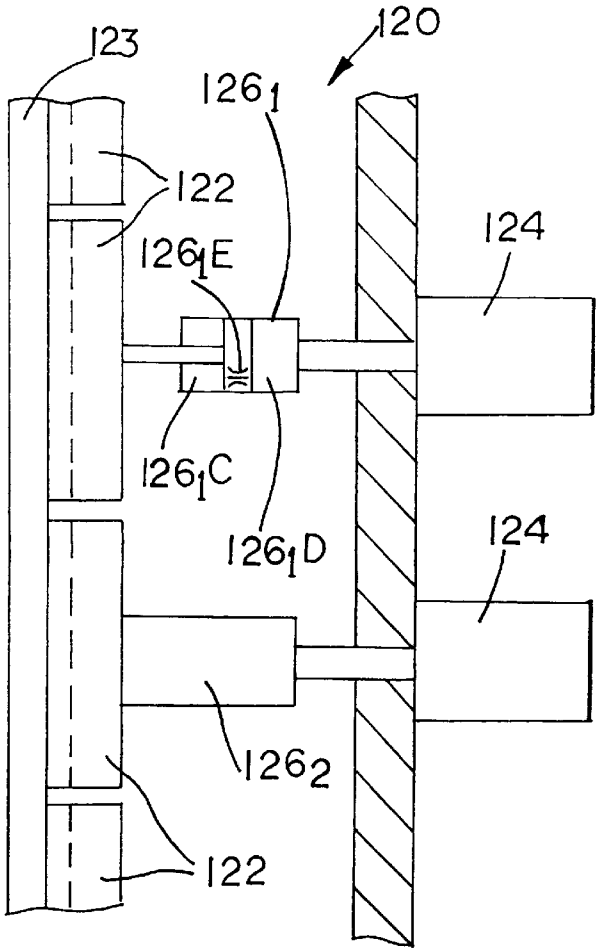
FIG. 3 is a top view of another embodiment of a leveling and/or metering device of the present invention.

In place of the coil springs 26, other types of springs may be provided. The spring element $\mathbf{126}_1$ in FIG. 3 is a gas spring and the spring element $\mathbf{126}_2$ is a spring element of rubber or a rubber-type material. The gas spring $\mathbf{126}_1$ offers the advantage that, through appropriate construction of the fluid passages $\mathbf{126}_1e$ connecting the two fluid chambers $\mathbf{126}_1c$ and $\mathbf{126}_1d$, a damping effect can be provided in addition to the spring effect, which counteracts vibrations in the entire control mechanism 120. An appropriate damping effect may also be provided by the rubber buffer $\mathbf{126}_2$ due to its material characteristics. The damping effect may also be provided by the contact bar 22 alone, based on suitable material selection and construction.

A low efficiency power component having relatively poor positioning accuracy of the actuator, and having a long adjustment stroke, can be utilized for the leveling and/or metering device according to the invention. Such power components are available cheaply on the market. A spring element converts the regulating distance of the power component into an actuating power which acts upon the contact bar. The spring characteristic curve of the spring element can be selected appropriately so that, in spite of the inaccurate positioning of the actuator, the precision of the contact pressure of the contact bar in conventional systems is equivalent if not superior.

It must also be mentioned that any type of power component may be utilized, for example electromotive, hydraulic, pneumatic, or hydro-pneumatic power components. Specifically, power components having a linear drive or a rotary drive may be utilized.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for at least one of leveling and metering a layer of coating medium on a surface of a substrate, said substrate being one of a traveling fiber material web and a transfer element, the transfer element being configured for transferring the coating medium to a traveling fiber material web, said substrate having a width, said apparatus comprising:

an element configured for at least one of leveling and metering the coating medium;

at least one power component configured for positioning said element against the substrate surface;

a power transfer device interconnecting said element and said at least one power component, said power transfer device being configured for transferring power from said at least one power component to said element; and a spring arrangement interconnecting said at least one power component and said power transfer device, said spring arrangement being configured for transferring power from said at least one power component to said power transfer device, said spring arrangement being comprised of at least one spring element, each said spring element having a first end and a second end, said first end thereof being connected to one said power component and said second end thereof being connected to said power transfer device.

2. The apparatus of claim 1, further comprising a support supporting said at least one power component, said power transfer device being mounted on said support, said power transfer device configured for being flexibly deformed by said at least one power component and said at least one spring arrangement.

3. The apparatus of claim 1, wherein said power transfer device includes synthetic material.

4. The apparatus of claim 1, wherein said spring arrangement comprises at least one of a tension spring, a compression spring and a tension/compression spring.

5. The apparatus of claim 1, wherein said spring arrangement includes a coil spring.

6. The apparatus of claim 1, wherein said spring arrangement includes at least one of a gas spring, a leaf spring, a rubber element and an element formed of a rubber material.

7. The apparatus of claim 1, further comprising at least one damping arrangement disposed between said at least one power component and said power transfer device.

8. The apparatus of claim 7, wherein said damping arrangement and said spring arrangement are formed integrally.

9. The apparatus of claim 1, wherein said at least one power component comprises a plurality of power components distributed transversely substantially across the width of the substrate.

10. The apparatus of claim 9, wherein said power transfer device comprises a plurality of power transfer elements.

11. The apparatus of claim 10, further comprising a continuous coupling device disposed between said plurality of power transfer elements and said element configured for at least one of leveling and metering, said continuous coupling device extending substantially across the width of the substrate, said continuous coupling device coupling together said plurality of power transfer elements.

12. The apparatus of claim 9, wherein said power transfer device comprises a single component.

13. The apparatus of claim 12, wherein said power transfer device includes at least one of a plurality of slots and a plurality of areas of lesser wall thickness, said at least one of a plurality of slots and a plurality of areas of lesser wall thickness being disposed at least a predetermined distance from said element configured for at least one of leveling and metering.

14. The apparatus of claim 1, wherein said element configured for at least one of leveling and metering comprises one of a doctor blade, a metering rod and a metering bar.

* * * * *